US010932568B2

(12) United States Patent
Subrahmanya et al.

(10) Patent No.: US 10,932,568 B2
(45) Date of Patent: Mar. 2, 2021

(54) MOTORIZED BASKET LIFTING MECHANISM

(71) Applicant: Haier US Appliance Solutions, Inc., Wilmington, DE (US)

(72) Inventors: Praveena Alangar Subrahmanya, Vittal (IN); Ranjith K S, Bantwal (IN); Bart Andrew Nuss, Fisherville, KY (US); Susheel Kumar Panda, Hyderabad (IN); Amruth M Devasahayam, Chennai (IN)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 16/522,771

(22) Filed: Jul. 26, 2019

(65) Prior Publication Data

US 2021/0022496 A1 Jan. 28, 2021

(51) Int. Cl.
*A47B 88/45* (2017.01)
*A47B 88/60* (2017.01)
(Continued)

(52) U.S. Cl.
CPC ..... *A47B 88/45* (2017.01); *A47B 88/60* (2017.01); *A47B 88/90* (2017.01); *F25D 25/025* (2013.01);
(Continued)

(58) Field of Classification Search
CPC ..... F25D 25/025; F25D 25/005; F25D 25/04; F25D 25/021; F25D 25/022; A47B 21/02; A47B 21/0314; A47B 17/02; A47B 2200/0041; A47B 2200/0042; A47B 2200/0043; A47B 88/45; A47B 88/90; A47B 88/60; A47B 2088/901; A47B 2210/175; A47B 2210/17; A47B 51/00; A47F 5/005; A47F 5/132
(Continued)

(56) References Cited

U.S. PATENT DOCUMENTS 2,739,864 A * 3/1956 Saunders ..... F25D 25/02 312/306
3,759,593 A * 9/1973 Walter ..... A47B 71/00 312/312
(Continued)

FOREIGN PATENT DOCUMENTS

CN 106642958 A 5/2017
DE 102014114285 * 4/2016
(Continued)

*Primary Examiner* — Janet M Wilkens
(74) *Attorney, Agent, or Firm* — Dority & Manning, P.A.

(57) ABSTRACT

A refrigerator appliance including a drawer lifting assembly is provided herein. The drawer lifting assembly may generally employ a motor to rotate a first linkage. The first linkage may be connected to a second linkage so that rotation of the first linkage causes movement of the second linkage. Movement of the second linkage may be constrained by interaction of a guide post connected to the second linkage and a horizontal rail on support frame assembly. This constraint may permit generally linear movement and pivoting of the second linkage. A basket may be connect to an end of the second linkage, wherein pivoting of the second linkage raises the basket.

20 Claims, 12 Drawing Sheets

(51) Int. Cl.
*F25D 25/02* (2006.01)
*A47B 88/90* (2017.01)

(52) U.S. Cl.
CPC ... *A47B 2088/901* (2017.01); *A47B 2210/175* (2013.01)

(58) Field of Classification Search
USPC ..... 312/402, 404, 319.5–319.8, 334.2; 248/421, 562, 588, 585, 431, 432, 439, 248/280.11, 292.11, 919, 920, 923
See application file for complete search history.

(56) References Cited

U.S. PATENT DOCUMENTS 5,474,376 A 12/1995 Saunders
7,527,343 B2 5/2009 Oh et al.
7,628,461 B2 * 12/2009 Carden ..... F25D 25/025 312/310
7,784,888 B2 8/2010 Oh et al.
8,231,190 B2 * 7/2012 Ertz ..... F25D 25/025 312/402
8,827,390 B2 * 9/2014 Wehner ..... A47B 96/00 312/405.1
9,107,494 B2 8/2015 Scheuring et al.
9,377,238 B2 6/2016 Hall et al.
2005/0073225 A1 4/2005 Kwon
2006/0021373 A1 2/2006 Oh et al.
2006/0022564 A1 * 2/2006 Oh ..... F25D 25/025 312/402
2006/0042305 A1 * 3/2006 Oh ..... F25D 25/025 62/407
2006/0043848 A1 * 3/2006 Jeong ..... F25D 25/025 312/310
2006/0043849 A1 3/2006 Oh et al.
2006/0066189 A1 3/2006 Bond
2006/0207283 A1 9/2006 Kim et al.
2007/0194674 A1 8/2007 Salter
2008/0018215 A1 1/2008 Carden et al.
2008/0156953 A1 7/2008 Oh et al.
2009/0193836 A1 8/2009 Ertz et al.
2014/0135994 A1 * 5/2014 Bhatt ..... A47B 88/497 700/275
2017/0350638 A1 12/2017 Park et al.
2018/0128540 A1 5/2018 Yasaka et al.

FOREIGN PATENT DOCUMENTS

DE 102018132800 * 11/2019
KR 100652583 B1 12/2006
KR 20110080874 * 7/2011
KR 20180064761 A1 6/2018
WO WO2014148977 A1 9/2014
WO WO2018086503 A1 5/2018
WO WO2018086504 A1 5/2018

* cited by examiner

MOTORIZED BASKET LIFTING MECHANISM

FIELD OF THE INVENTION

The present disclosure relates generally to a basket lifting assembly of a refrigerator appliance for the motorized lifting and lowering of the basket.

BACKGROUND OF THE INVENTION

Refrigerator appliances generally include a cabinet that defines one or more insulated chambers for the receipt and storage of food items. Certain refrigerator appliances include a fresh food chamber for storage of food items above the freezing temperature of water and a freezer chamber for storage of food items below the freezing temperature of water. The fresh food chamber and the freezer chamber can be positioned at various locations relative to each other within the cabinet. Consumers generally prefer chilled chambers that facilitate visibility and accessibility of food items stored therein. However, the arrangement of the fresh food chamber and the freezer chamber within a refrigerator appliance's cabinet can affect food items' visibility and accessibility.

In certain refrigerator appliances, commonly referred to as side-by-side style refrigerator appliances, the fresh food chamber is positioned next to the freezer chamber within the cabinet. Such a configuration can permit easy access to food items stored on doors of the refrigerator appliances. In other refrigerator appliances, commonly referred to as bottom mount refrigerator appliances, the freezer chamber is positioned below the fresh food chamber in the cabinet. Such a configuration can provide a wide fresh food chamber or a wide freezer chamber. However, in either case, space near the floor of the insulated chambers is utilized, making access difficult particularly for elderly and infirm users.

Many refrigerator appliances address this problem by providing drawers in the lower portions of the insulated chambers so that users need to reach both down to the bottom of the refrigerator and inward toward the back of the refrigerator. While such solutions do aid in accessibility, they do not address the fundamental problem that items stored within the drawers are too low to reach without requiring many users to bend down or kneel.

Accordingly, a refrigerator appliance having a slidable drawer with a motorized basket lifting assembly would be useful in increasing accessibility to contents of the refrigerator appliance.

BRIEF DESCRIPTION OF THE INVENTION

Aspects and advantages of the invention will be set forth in part in the following description, or may be obvious from the description, or may be learned through practice of the invention.

In one aspect of the present disclosure, a refrigerator appliance is provided. The refrigerator appliance may include a cabinet, an insulated chamber mounted within the cabinet, and a basket lifting assembly. The basket lifting assembly may include a support frame assembly, a basket movably attached to the support frame assembly, a first linkage, a motor, and a second linkage. The support frame assembly may be at least partially contained within the insulated chamber and further include a horizontal rail. The first linkage may be movably attached to the support frame assembly in mechanical communication with the basket.

The motor may be connected to the first linkage, wherein actuation of the motor causes rotation of the first linkage. The second linkage may further include a first arm, a second arm, and a guide post. The first arm of the second linkage may have a first end and a second end, the first end of the first arm connected to the first linkage. The second arm of the second linkage may have a first end and a second end, the first end of the second arm connected to the basket and the second end of the second arm connected to the second end of the first arm at an arm joint defining an angle of less than 180 degrees. The guide post may be positioned between the second linkage and the horizontal rail and be connected to the second linkage at the arm joint.

In another aspect of the present disclosure, a basket lifting assembly is provided. The basket lifting assembly may include a support frame assembly, a basket movably attached to the support frame assembly, a first linkage, a motor, and a second linkage. The support frame assembly may include a horizontal rail. The first linkage may be movably attached to the support frame assembly in mechanical communication with the basket. The motor may be connected to the first linkage, wherein actuation of the motor causes rotation of the first linkage. The second linkage may further include a first arm, a second arm, and a guide post. The first arm of the second linkage may have a first end and a second end, the first end of the first arm connected to the first linkage. The second arm of the second linkage may have a first end and a second end, the first end of the second arm connected to the basket and the second end of the second arm connected to the second end of the first arm at an arm joint defining an angle of less than 180 degrees. The guide post may be positioned between the second linkage and the horizontal rail and be connected to the second linkage at the arm joint.

These and other features, aspects, and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
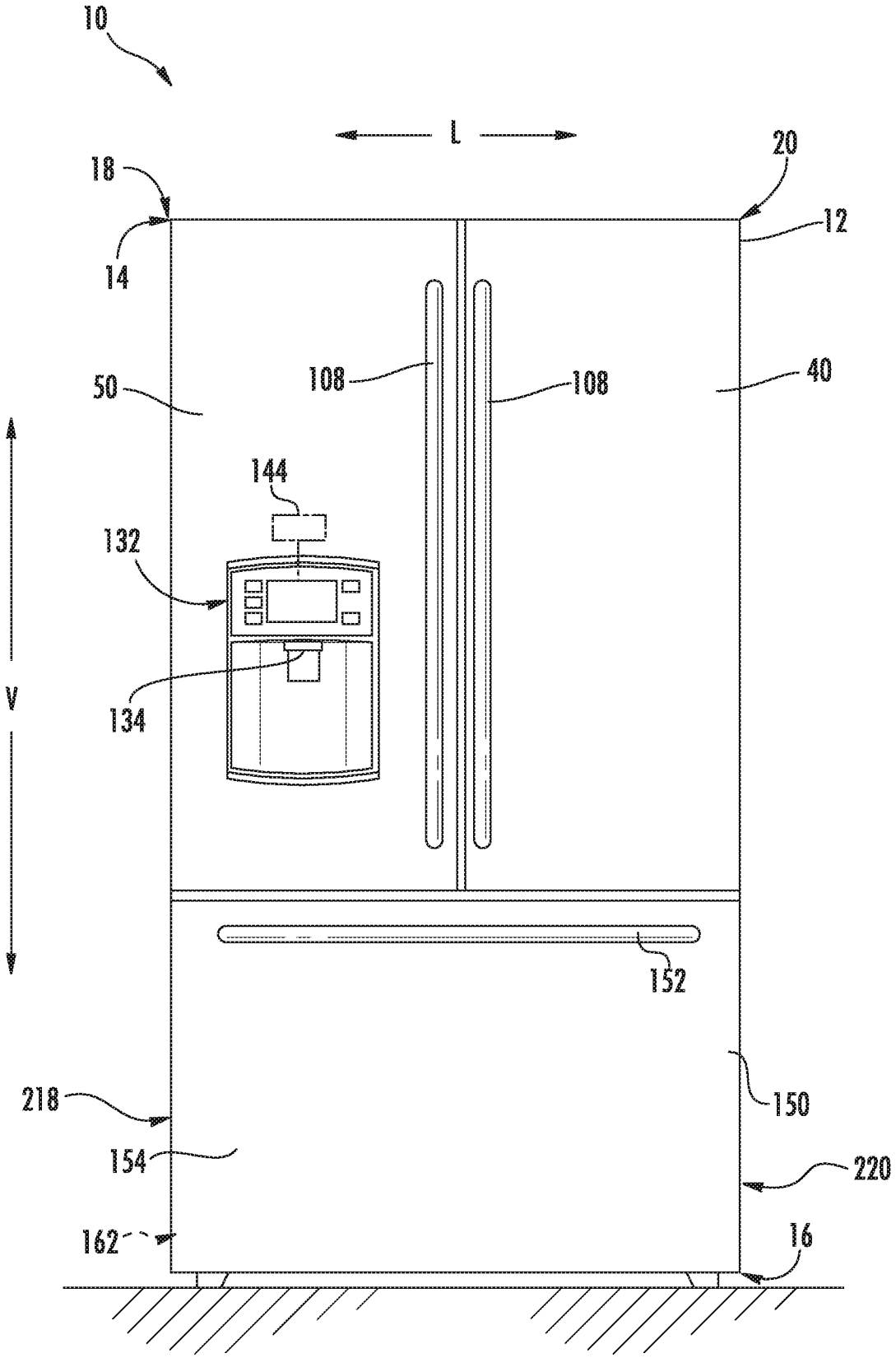
FIG. 1 provides a front elevation view of a refrigerator appliance according to exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents In order to aid understanding of this disclosure, several terms are defined below. The defined terms are understood to have meanings commonly recognized by persons of ordinary skill in the arts relevant to the present invention. The terms "includes" and "including" are intended to be inclusive in a manner similar to the term "comprising." Similarly, the term "or" is generally intended to be inclusive (i.e., "A or B" is intended to mean "A or B or both"). The terms "first," "second," and "third" may be used interchangeably to distinguish one component from another and are not intended to signify location or importance of the individual components. Terms such as "inner" and "outer" refer to relative directions with respect to the interior and exterior of the refrigerator appliance, and in particular the food storage chamber(s) defined therein. For example, "inner" or "inward" refers to the direction towards the interior of the refrigerator appliance. Terms such as "left," "right," "front," "back," "top," or "bottom" are used with reference to the perspective of a user accessing the refrigerator appliance. For example, a user stands in front of the refrigerator to open the doors and reaches into the food storage chamber(s) to access items therein.

Figure 2:
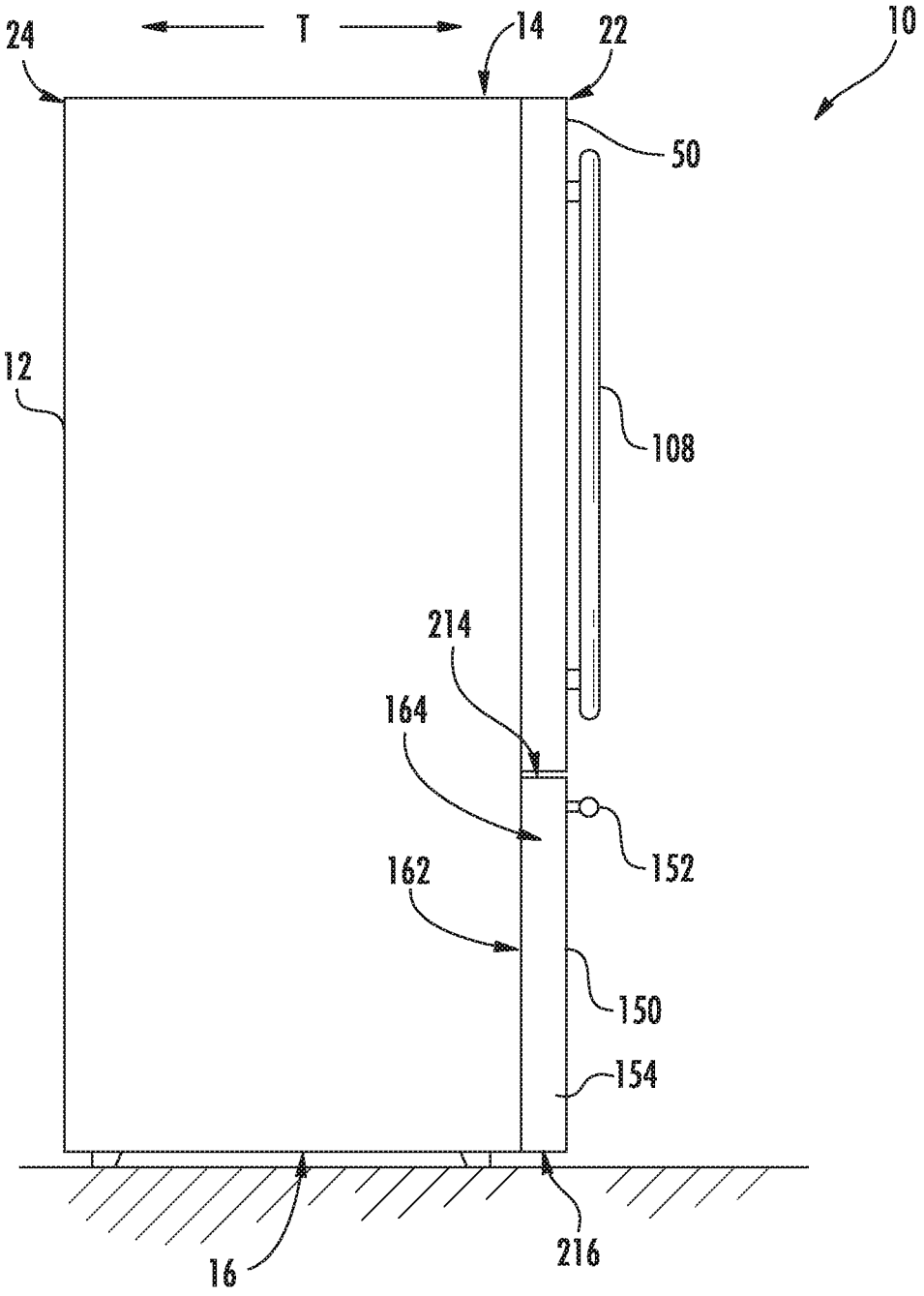
FIG. 2 provides a side view of the exemplary refrigerator appliance of FIG. 1.
Figure 3:
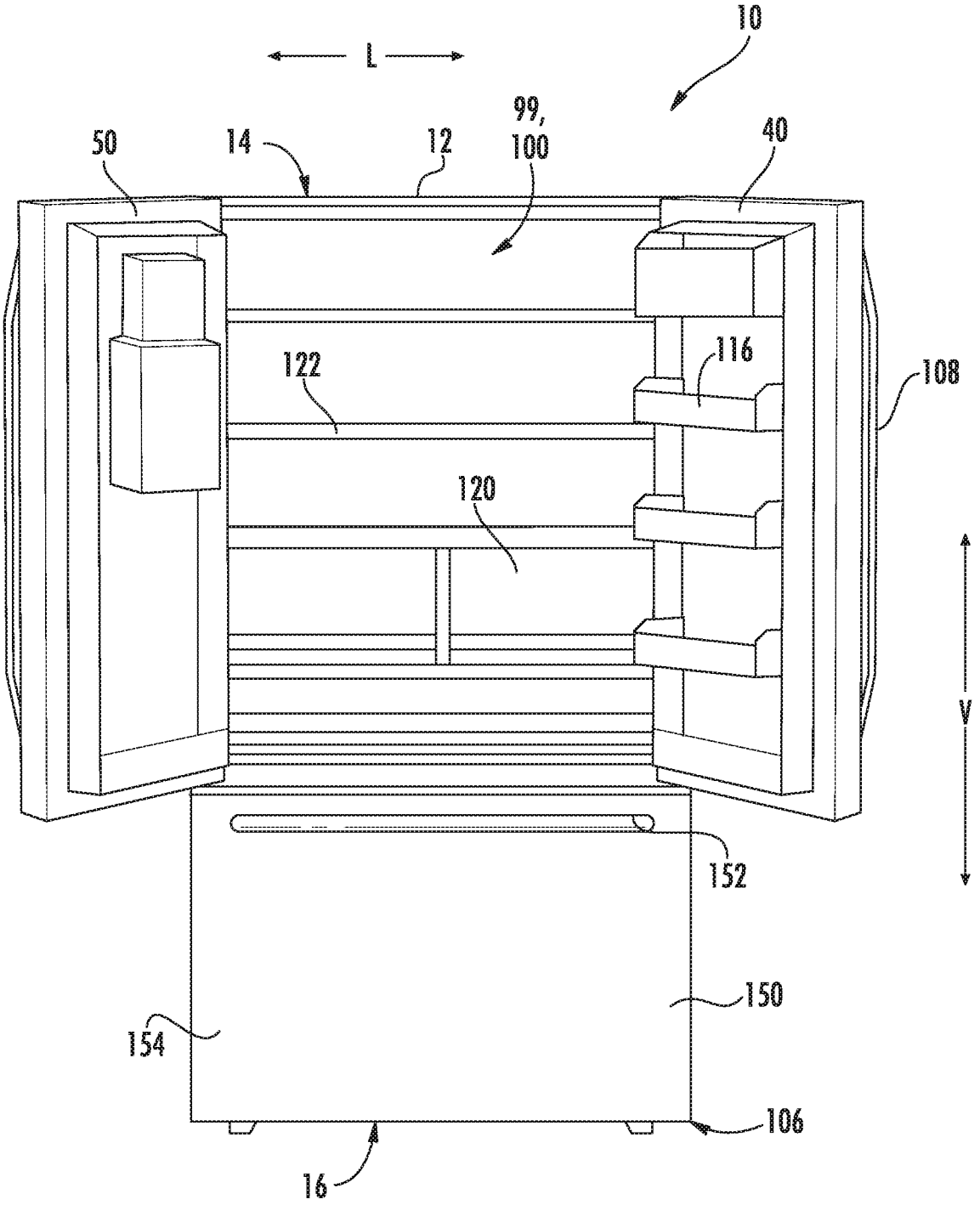
FIG. 3 provides a front perspective view of the exemplary refrigerator appliance of FIG. 1 with the refrigerator doors shown in an open position.

Turning now to the figures, FIGS. 1 through 3 provide multiple views of a refrigerator appliance 10 according to exemplary embodiments of the present disclosure. FIG. 1 provides a front elevation view of a refrigerator appliance 10. FIG. 2 provides a side view of the exemplary refrigerator appliance 10. FIG. 3 provides a front perspective view of refrigerator appliance 10 with a pair of refrigerator doors 40, 50 shown in an open position.

Generally, refrigerator appliance 10 includes a housing or cabinet 12 that defines a vertical direction V, a lateral direction L, and a transverse direction T (see, e.g., FIG. 2), each mutually perpendicular to one another. As shown, cabinet 12 extends between a top portion 14 and a bottom portion 16 along the vertical direction V, between a first (e.g., left) side 18 and a second (e.g., right) side 20 along the lateral direction L, and between a front side 22 and a rear side 24 along the transverse direction T.

Cabinet 12 defines one or more insulated chambers 99, which may include a separate fresh food chamber 100 and freezer chamber 102 for receipt of food items for storage. In particular, the fresh food chamber 100 is positioned at or adjacent the top portion 14 of cabinet 12. Freezer chamber 102 is positioned below fresh food chamber 100 along the vertical direction V (e.g., at or adjacent the bottom 16 of cabinet 12). It should be appreciated, however, that the fresh food and freezer chambers 100, 102, may be positioned at another suitable location within the refrigerator appliance 10.

Figure 6:
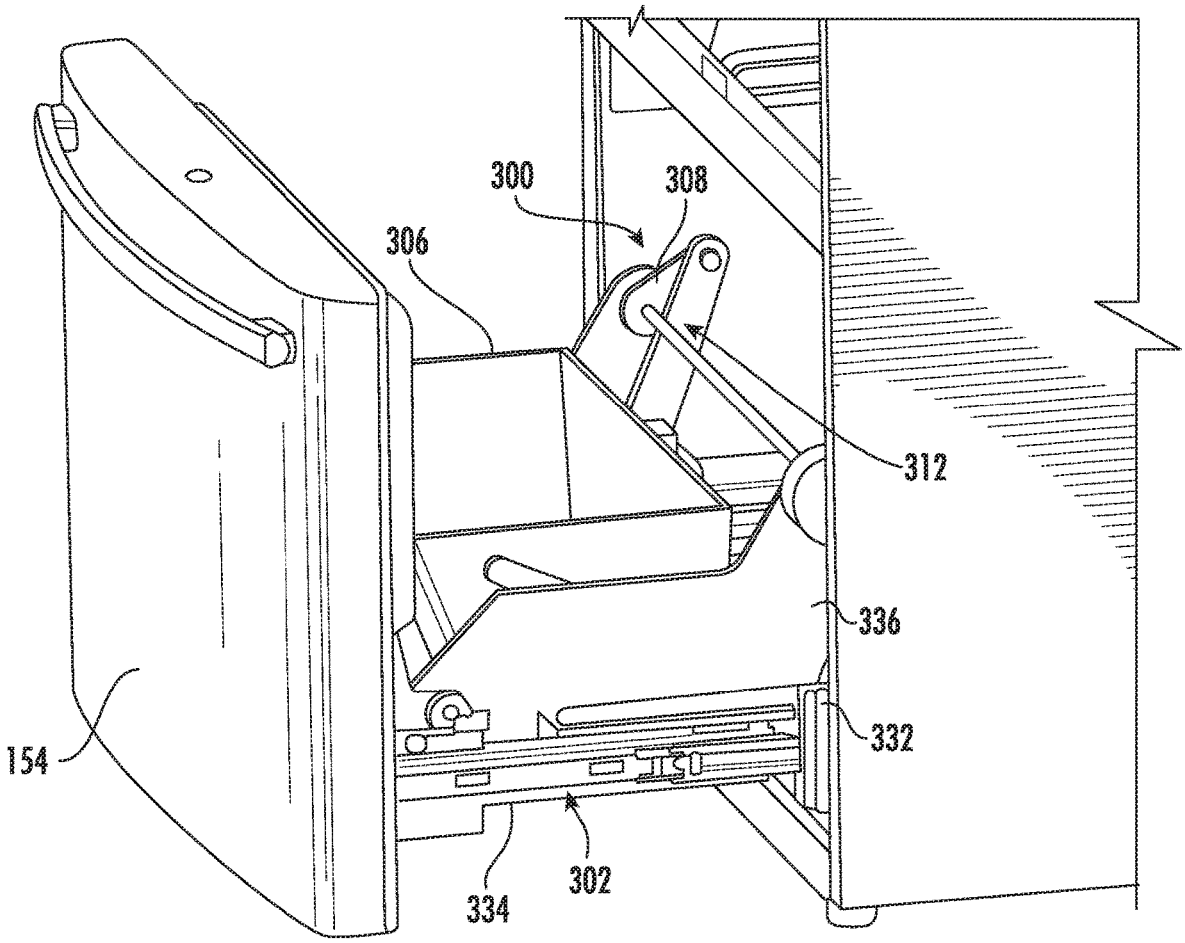
FIG. 6 is a side perspective view of refrigerator appliance with a basket lifting assembly according to exemplary embodiments of the present disclosure.

The refrigerator appliance 10 may also include a dispenser assembly 132 for dispensing liquid water or ice. The dispenser assembly 132 includes a dispenser 134 positioned on or mounted to an exterior portion of the refrigerator appliance 10, e.g., on the left refrigerator door 50. In addition, as will be described in detail below, the refrigerator appliance 10 may include a basket lifting assembly 300 (e.g., as shown in the embodiment of FIG. 6) arranged below the refrigerator doors 40, 50 for selectively accessing items within freezer chamber 102.

Refrigerator appliance 10 further includes a controller 144 to generally regulate refrigerator appliance 10. Controller 144 may be provided in communication (e.g., electrically coupled) with a dispenser assembly 132. In exemplary embodiments, a control panel is included as general purpose I/O ("GPIO") device or functional block. In other exemplary embodiments, a control panel is included with multiple input components, such as one or more of a variety of electrical, mechanical or electro-mechanical input devices including rotary dials, push buttons, touch pads, and touch screens. The control panel may be in communication (e.g., electrically coupled) with controller 144 via one or more signal lines or shared communication busses.

Controller 144 includes memory and one or more processing devices such as microprocessors, CPUs or the like, such as general or special purpose microprocessors operable to execute programming instructions or micro-control code associated with operation of refrigerator appliance 10. The memory can represent random access memory such as DRAM, or read only memory such as ROM or FLASH. The processor executes non-transitive programming instructions stored in the memory. The memory can be a separate component from the processor or can be included onboard within the processor. Alternatively, controller 144 may be constructed without using a microprocessor, e.g., using a combination of discrete analog or digital logic circuitry (such as switches, amplifiers, integrators, comparators, flip-flops, AND gates, and the like) to perform control functionality instead of relying upon software.

In some embodiments, refrigerator appliance 10 may include a handle 152 attached to a door 154. Basket lifting assembly 300, including door 154, may be slidably mounted to cabinet 12. Accordingly, a user may utilize handle 152 to basket lifting assembly 300 in and out of freezer chamber 102 along the transverse direction T.

Generally, door 154 extends in the lateral direction L between a first side 218 and a second side 220, and in the vertical direction V between a top 214 and a bottom 216. As shown, door 154 includes an outer surface 158 (e.g., directed away from cabinet 12) and an inner surface 160 (e.g., directed toward cabinet 12) that extend in the lateral direction L from first side 218 to second side 220. When assembled, door 154 may selectively cover a cabinet opening 162 permitting access to freezer chamber 102.

As shown in FIG. 3, various storage components may be mounted within the food storage chamber 100 to generally facilitate storage of food items. In certain embodiments, the storage components include bins 116, drawers 120, and shelves 122 that are mounted within the fresh food chamber 100. The bins 116, drawers 120, and shelves 122 are configured for receipt of food items (e.g., beverages or solid food items) and may assist with organizing such food items.

Figure 4:
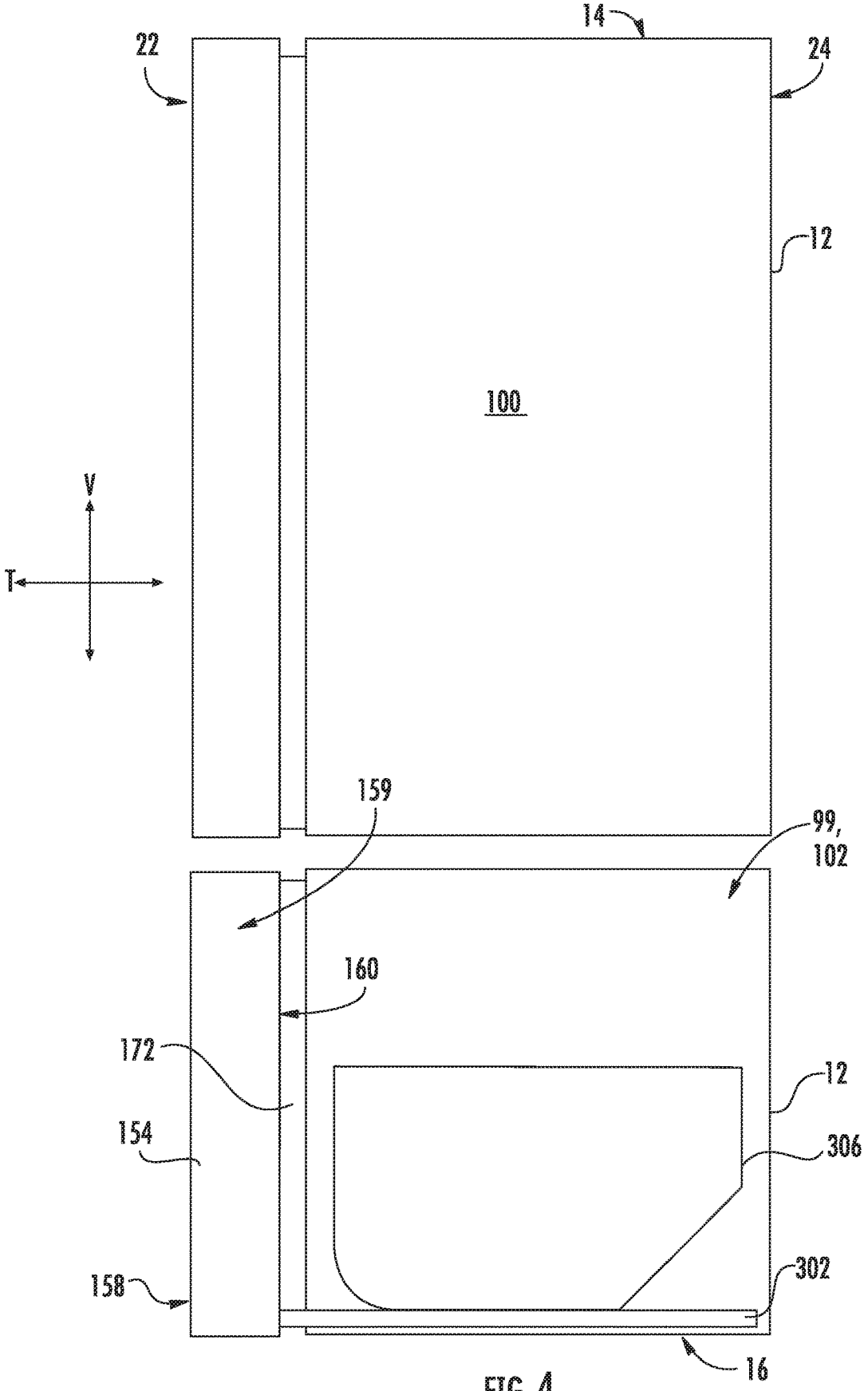
FIG. 4 is a side schematic view of a refrigerator appliance according to exemplary embodiments of the present disclosure.
Figure 5:
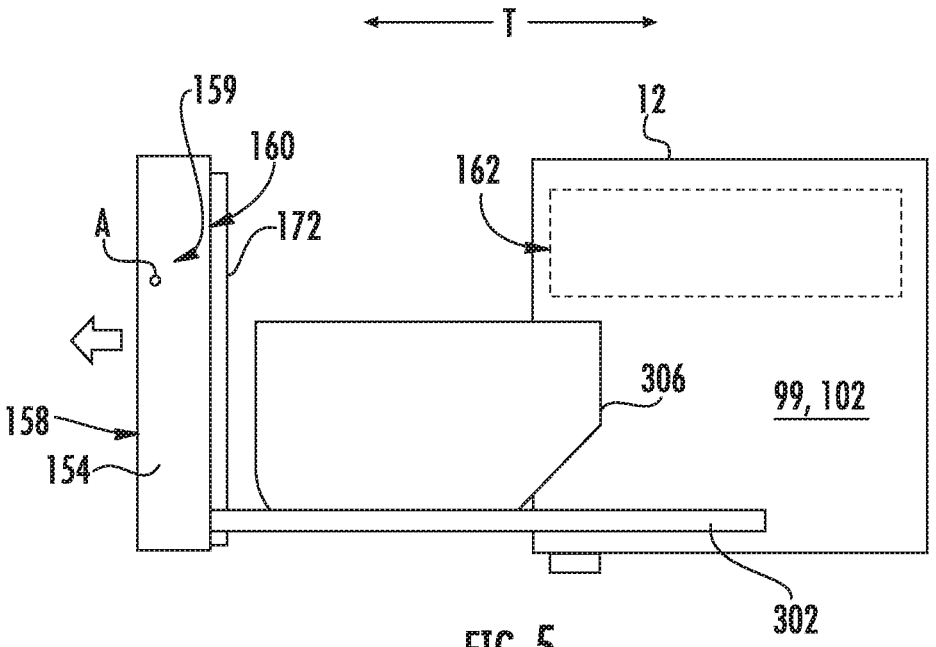
FIG. 5 is a side schematic view of a portion of refrigerator appliance according to exemplary embodiments of the present disclosure, wherein a door is extended in a primary open position.

Turning to FIGS. 4 through 5, various schematic views of exemplary embodiments of refrigerator appliance 10, and especially freezer chamber 102, are provided. As illustrated in FIGS. 4 and 5, door 154 is slidably mounted to cabinet 12. Specifically, door 154 may move along the transverse direction T between a primary open position (FIG. 5) and a primary closed position (FIG. 4). In the primary open position, primary opening 162 is generally uncovered and access to freezer chamber 102 is permitted (e.g., by a user reaching through primary opening 162). By contrast, in the closed position, primary opening 162 is substantially covered and access to freezer chamber 102 is restricted. For instance, door 154 may engage cabinet 12, spanning across primary opening 162 along the vertical direction V and the lateral direction L (see, e.g., FIG. 1), thereby blocking at least a portion of the freezer chamber 102 along the transverse direction T. In other embodiments, door 154 may be pivotably mounted to cabinet 12, thereby exposing primary opening 162 upon the opening of the door 154.

In some embodiments, a primary gasket 172 is positioned on or attached to door 154 (e.g., on an inner surface 160 of door 154). As the door 154 moves towards the closed position, the door 154 may contact and compress the primary gasket 172 against a corresponding outer surface of cabinet 12. Specifically, the primary gasket 172 may seal against the outer surface of the cabinet 12 to enclose freezer chamber 102. In alternative embodiments, the primary gasket 172 may be positioned on the outer surface 158 of the cabinet 12 and, as the door 154 moves towards the closed position, the cabinet 12 may compress the primary gasket 172 against the inner surface 160 of door 154. More specifically, the primary gasket 172 may seal against the inner surface 160 of the door 154. It should be appreciated that the primary gasket 172 may be comprised of any suitable material. For example, in one embodiment, the primary gasket 172 may be comprised of a resilient rubber or plastic material.

Figure 7A:
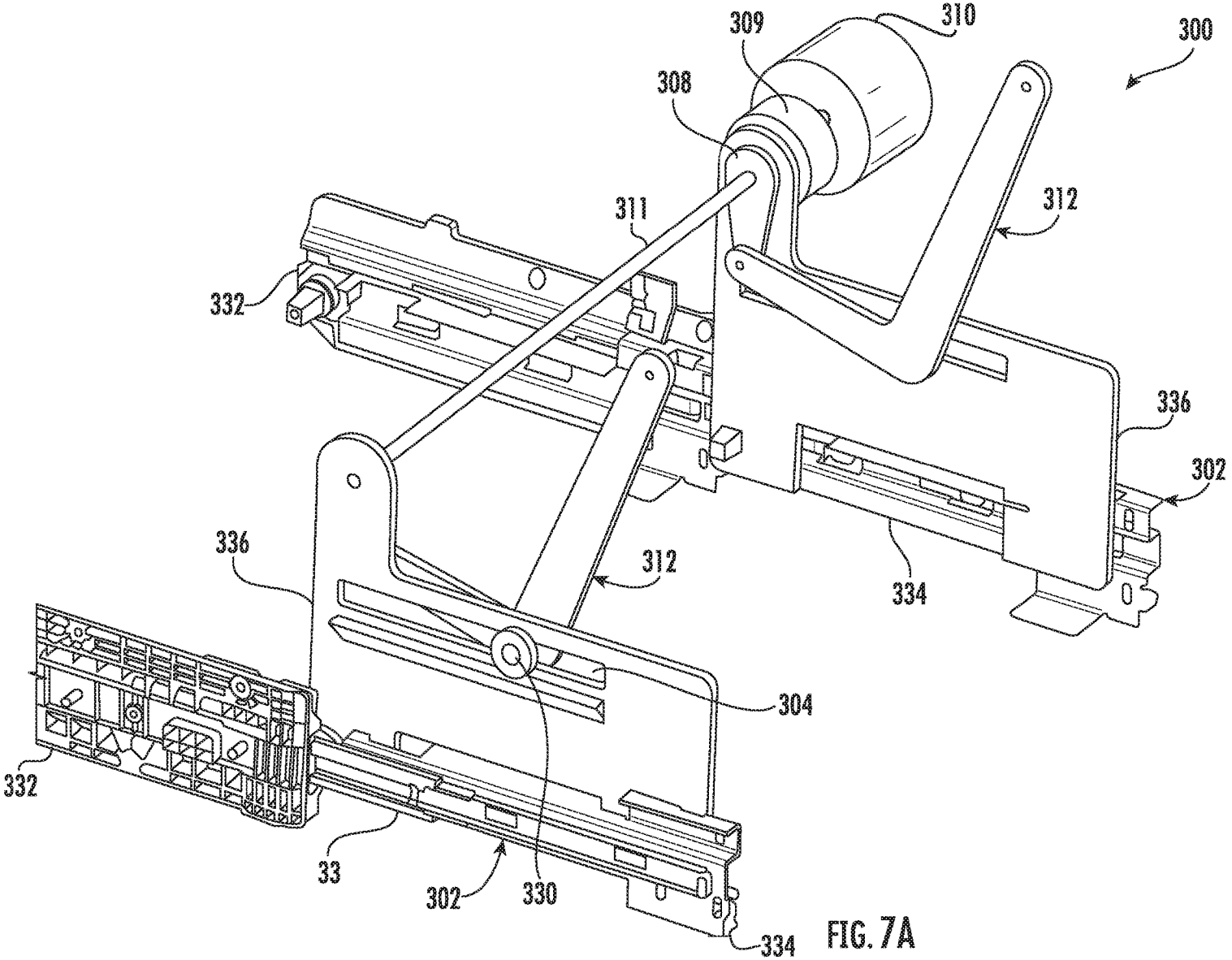
FIG. 7A is a side perspective view of a basket lifting assembly according to exemplary embodiments of the present disclosure showing the position of components when a basket is in a lifted position, though with the basket omitted to allow for a view of other elements.
Figure 7B:
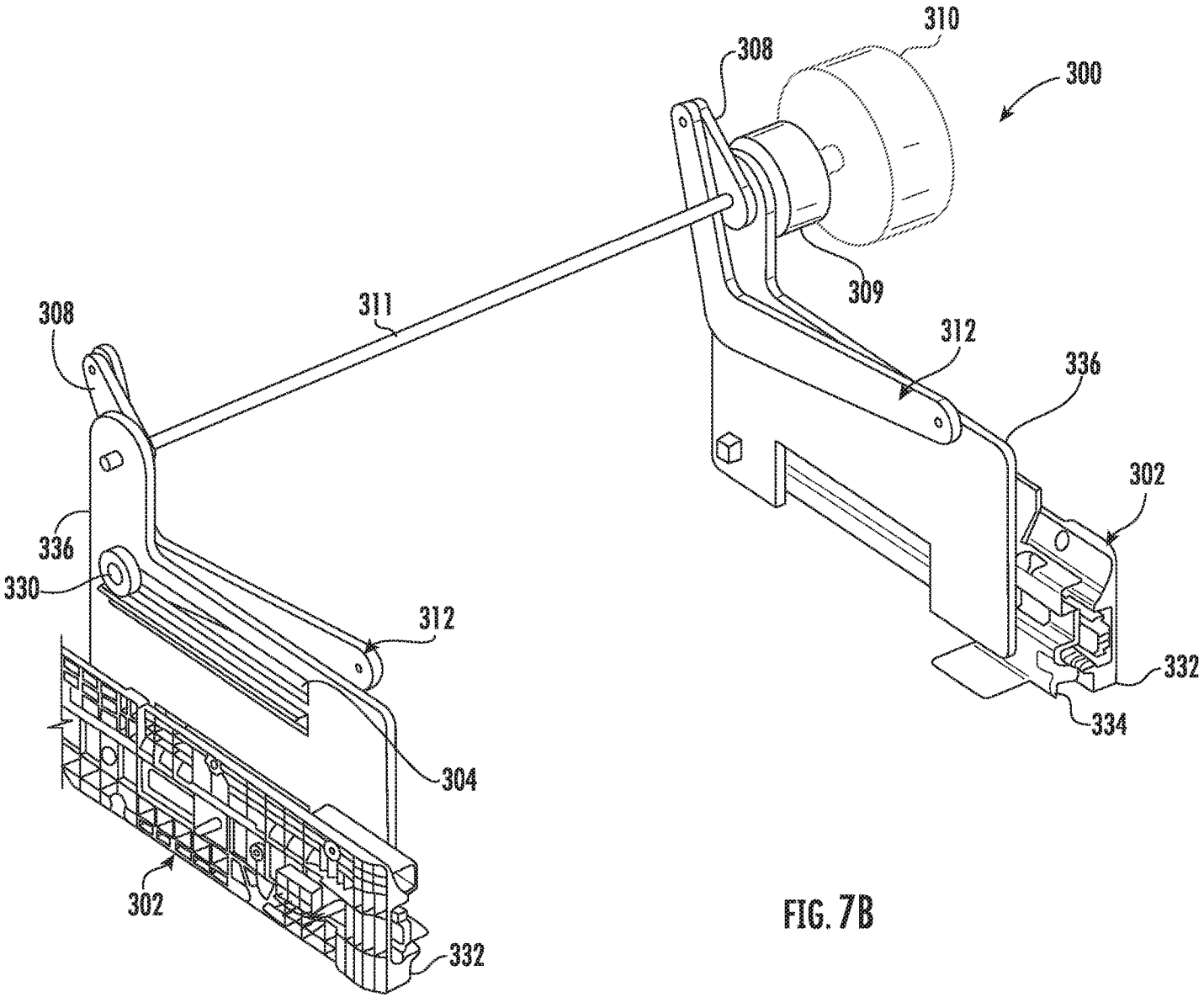
FIG. 7B is a side perspective view of a basket lifting assembly according to exemplary embodiments of the present disclosure showing the position of components when a basket is in a lowered position, though with the basket omitted to allow for a view of other elements.

Turning now to FIGS. 6, 7A, and 7B, various perspective views of exemplary embodiments of basket lifting assembly 300 are provided. Basket lifting assembly 300 generally permits lifting of a basket for easier access to the contents of the basket. In particular, basket lifting assembly 300 may include a support frame assembly 302, a basket 306, a first linkage 308, a motor 310, and a second linkage 312. Generally, actuation of motor 310 may cause rotation of first linkage 308 to which motor 310 may be connected. First linkage 308 may be connected to second linkage 312 and rotation of first linkage 308 may thus result in the linear translation and pivoting of second linkage 312. Basket 306 may be further connected to second linkage 312 and thus the pivoting of second link 312 may result in the lifting of basket 306. The detailed description below of basket lifting assembly 300, its components, and their interaction will further illustrate these operations.

Referring to the embodiment of FIG. 6, support frame assembly 302 is mounted to cabinet 12 in order that basket 306 may slide along the transverse direction T for receipt within freezer chamber 102. As such, support frame assembly 302 may be at least partially contained within freezer chamber 102. Support frame assembly 302 may further include or define a horizontal rail 304 for supporting second linkage 312, as further described below. In some embodiments, support frame assembly 302 includes a first support bracket 332 mounted (e.g., fixedly mounted) within freezer chamber 102. Additionally, support frame assembly 302 may comprise a second support bracket 334 slidably connected to first support bracket 332. Second support bracket 334 may be movable between a retracted position within freezer chamber 102 (as shown in FIG. 7B) and an extended position at least partially outside of the freezer chamber 102 (as shown in FIG. 7A). In some such embodiments, basket 306 is supported by second support bracket 334 and thus can also slide between the retracted and extended positions.

Further, support frame assembly 302 may also comprise a mounting frame 336. In some embodiments, mounting frame 336 is connected to second support bracket 334 and oriented vertically. In embodiments employing mounting frame 336, mounting frame 336 may define horizontal rail 304, as discussed above with regard to support frame assembly 302 generally and further detailed below. In alternative embodiments, basket lifting assembly 300 may be stationary (e.g., not slidable) with respect to freezer chamber 102 (or other insulated chamber 99). In some such embodiments, second support bracket 334 would be unnecessary and mounting frame 336 may connect directly to first support bracket 332. In other alternative embodiments, first support bracket 332 and mounting frame 336 form a unitary structure mounted either within freezer chamber 102 or to door 154.

As shown in FIG. 6, door 154 may be mounted (e.g., fixedly mounted) to support frame assembly 302. In particular embodiments, second support bracket 334 is connected to door 154 and may be actuated for synchronized movement with door 154. In other words, second support bracket 334 may slide with door 154 (e.g., as a user opens and closes door 154).

In some embodiments, basket 306 is included with basket lifting assembly 300. For instance, basket 306 may be slidably mounted to cabinet 12 for receipt within freezer chamber 102. Optionally, basket 306 may be attached to second support bracket 334 such that basket 306 may be further actuated for synchronized movement with door 154.

FIGS. 7A and 7B provide a perspective view of basket lifting assembly 300, with basket 306 removed to facilitate an unobstructed view of the remainder of basket lifting assembly 300. As illustrated in FIGS. 7A and 7B, basket lifting assembly 300 further comprises a motor 310 to provide at least a portion of the force necessary to lift basket 306. Optionally, motor 310 employs a self-locking worm gearbox. Advantageously, a self-locking worm gearbox resists the force generated by motor 310, reducing the rotational speed (e.g., revolutions per minute) at which motor 310 may operate. This resistance of the worm gearbox prevents unintentional rotation of the motor that might otherwise occur as a result of the load applied (e.g., from the weight of basket 306 and its contents in the lifted position). Additionally or alternatively, the reduced speed of rotation of motor 310 directly translates to basket 306 being lifted a lower speed, thus facilitating safe movement of basket 306. In other embodiments, the motor may employ other types of gearboxes known in the art consistent with this disclosure.

In certain embodiments, motor 310 may be attached (e.g., fixedly attached) to a coupler 309, which in turn may be attached (e.g., fixedly attached) to a shaft 311. Shaft 311 may extend through mounting frame 336, thus anchoring it to the basket lifting assembly 300. First linkage 308 may then be connected to shaft 311. Thus, actuation of motor 310 results in rotation of coupler 309, shaft 311, and first linkage 308. By virtue of the anchoring of shaft 311 discussed above, first linkage 308 may be movably attached to support frame assembly 302 (via mounting frame 336).

Figure 8A:
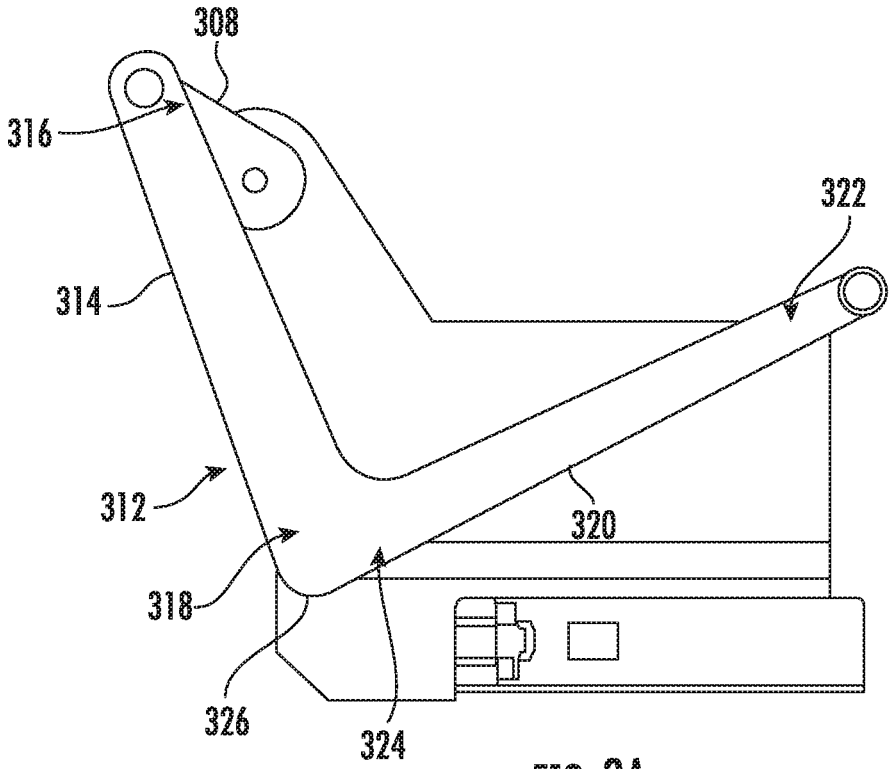
FIG. 8A is a side view of a basket lifting assembly (without the basket) according to exemplary embodiments of the present disclosure showing the position of components when the basket is in the lowered position.
Figure 8B:
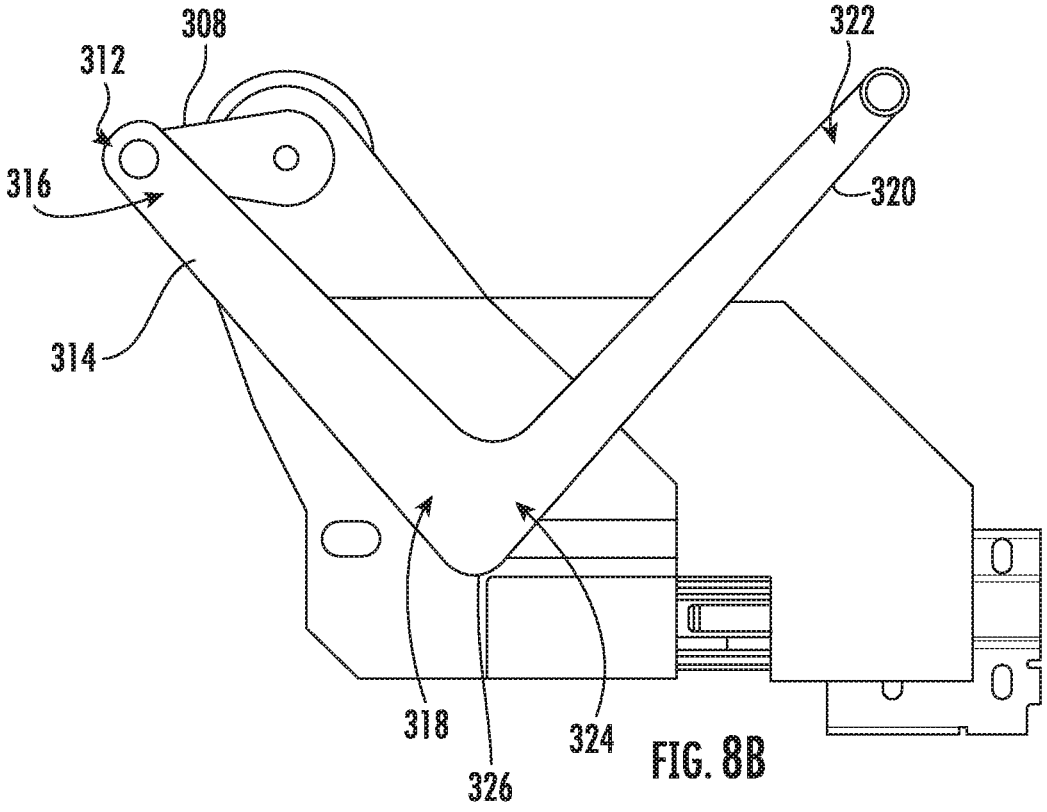
FIG. 8B is a side view of a basket lifting assembly (without the basket) according to exemplary embodiments of the present disclosure showing the position of components when the basket is in the partially raised position.
Figure 8C:
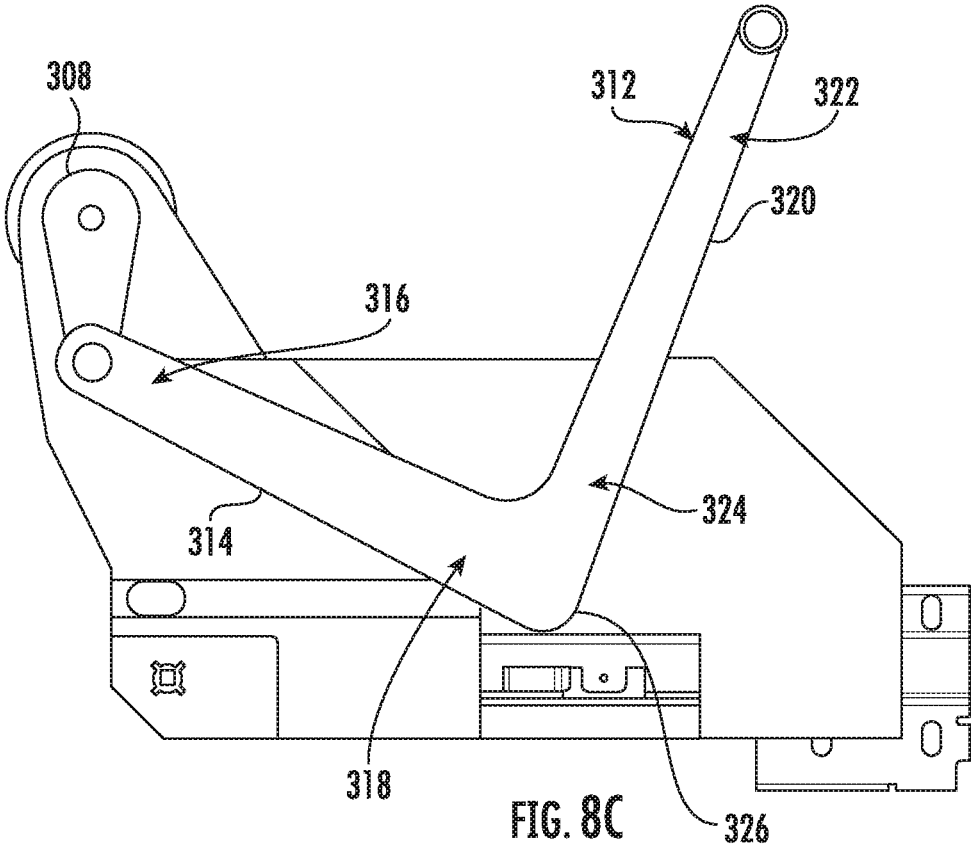
FIG. 8C is a side view of a basket lifting assembly (without the basket) according to exemplary embodiments of the present disclosure showing the position of components when the basket is in the raised position.
Figure 10:
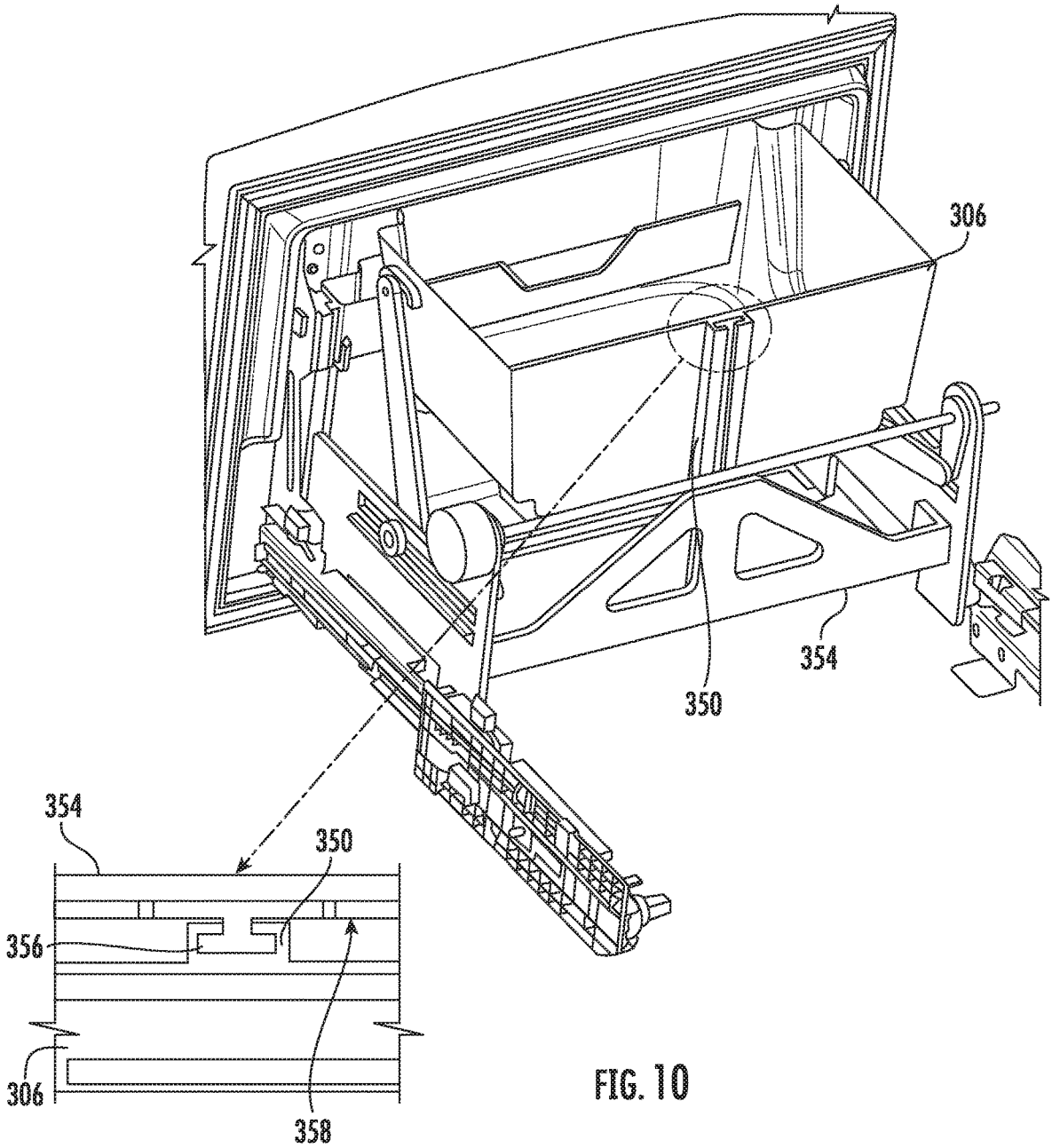
FIG. 10 is a rear perspective view of a basket lifting assembly employing a basket lift guide according to exemplary embodiments of the present disclosure.

As also shown in the embodiments of FIGS. 8A through 8C, first linkage 308 may further be connected to second linkage 312. Any suitable manner of connection (e.g., key slot connection) may be employed. Second linkage 312 is comprised of a first arm 314 and a second arm 320. First arm 314 has a first end 316 and second end 318. Likewise, second arm 320 has a first end 322 and a second end 324. First end 316 of first arm 314 may be connected to first linkage 308. Additionally, second end 318 of first arm 314 and second end 324 of second arm 320 are connected to one another at an arm joint 326 defining an arm angle (e.g., fixed arm angle) between first arm 314 and second arm 320 of less than 180 degrees. Further, second end 324 of second arm 320 is connected to basket 306, as shown in the embodiment of FIG. 10, and thus basket 306 may be movably attached to support frame assembly 302.

Referring again to FIGS. 7A and 7B, second linkage 312 further includes a guide post 330 connected to second linkage 312 at arm joint 326. Guide post 330 is positioned between second linkage 312 and horizontal rail 304 and interacts with and is supported by horizontal rail 304. Horizontal rail 304 may take the form of a ridge, a slot, a recess, or any suitable structure for supporting guide post 330 and limiting its range of motion in the vertical direction V. Further a protective covering (not shown) may be mounted over portions of basket lifting assembly 300 (e.g., support frame assembly 302) for the safety of users, appearance, or to prevent jamming of moving elements of basket assembly 300.

Basket lifting assembly 300 may be optionally or selectively actuated by user input (e.g., voice activation, pressing of a button, or touch-screen selection). The user input is conveyed to controller 144. When the user input reflects the user's intention to raise or lower basket 306, controller 144 may actuate motor 310 in the appropriate direction. In the event that the user elects to raise basket 306 from a lowered position, basket lifting mechanism 300 may begin in the position shown in FIG. 8A. Actuation of motor 310 may rotate coupler 309 and shaft 311. Rotation of these elements may cause first linkage 308 to similarly rotate. As a result of the connection between first linkage 308 and second linkage 312 may force movement of second linkage 312. Because second linkage 312 may be connected to guide post 330 at arm joint 326, and movement of guide post 330 may be restrained by limited by horizontal rail 304, the movement of second linkage 312 may be generally parallel to horizontal rail 304. Furthermore, second linkage 312 may pivot about arm joint 326, where guide post 330 may be positioned, as shown in FIG. 8B-8C. Due to this pivoting of second linkage 312, second arm 320 of second linkage 312 may be elevated. Basket 306, which is attached to second arm 320 of second linkage 312, may likewise be elevated as a result of the movement of second linkage 312 until it is in a lifted position (FIG. 8C). In this way, basket 306 may be movably attached to support frame assembly 302. Advantageously, limiting rotation of motor 310 enables for the above-described basket lifting assembly 300 to lift and lower basket 306 in a substantially straight vertical line. As would be understood in light of the present disclosure, the distance over which basket 306 remains substantially vertical depends at least in part on the dimensions of the first linkage 310 and second linkage 312.

In optional embodiments, basket lifting assembly 300 further includes an overload protection to ensure motor 310 may not be overloaded. Overload protection may employ a load cell (not pictured) positioned at one or load-bearing connections (e.g., between first linkage 308 and second linkage 312 or between second linkage 312 and basket 306). A load cell may measure the load created by lifting of basket 306 and its contents. The load cell may be configured to correlate the load applied to the current consumption (e.g., at motor 310) and cut off actuation of the motor 310 in the event of an overload.

Figure 9A:
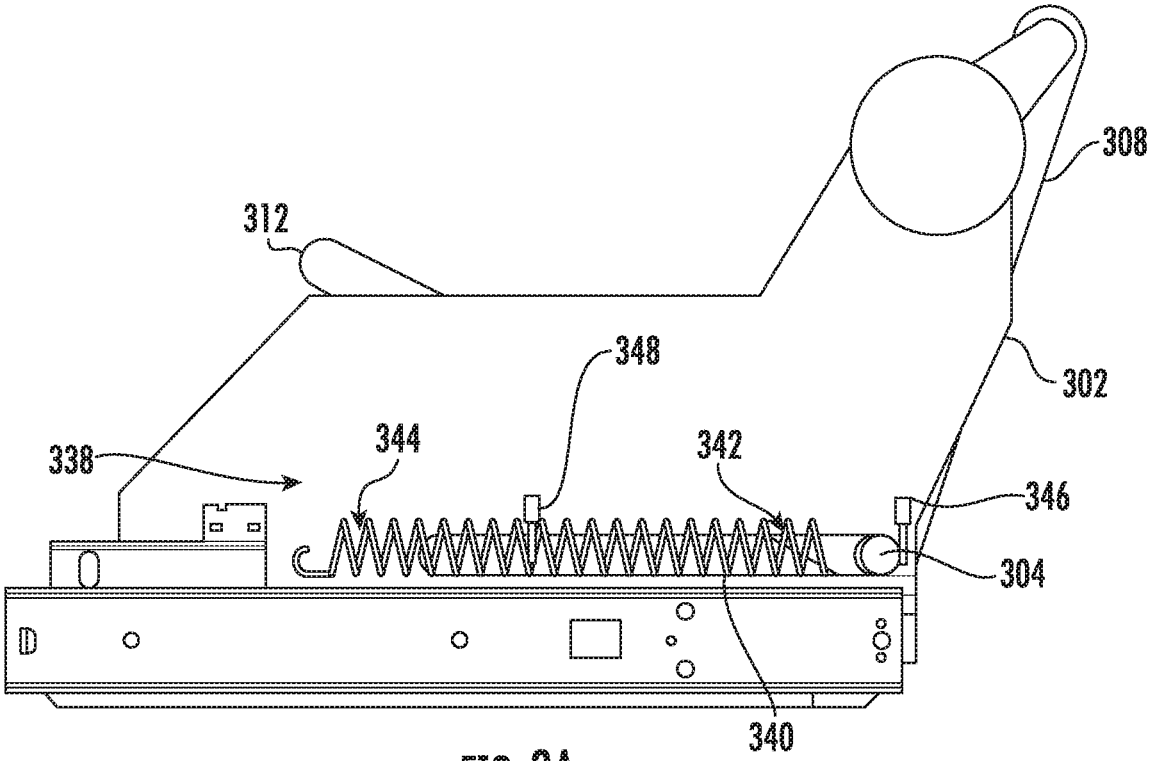
FIG. 9A is a side view of a basket lifting assembly (without the basket) aided by a coiled spring according to exemplary embodiments of the present disclosure, wherein the basket is in the lowered position.
Figure 9B:
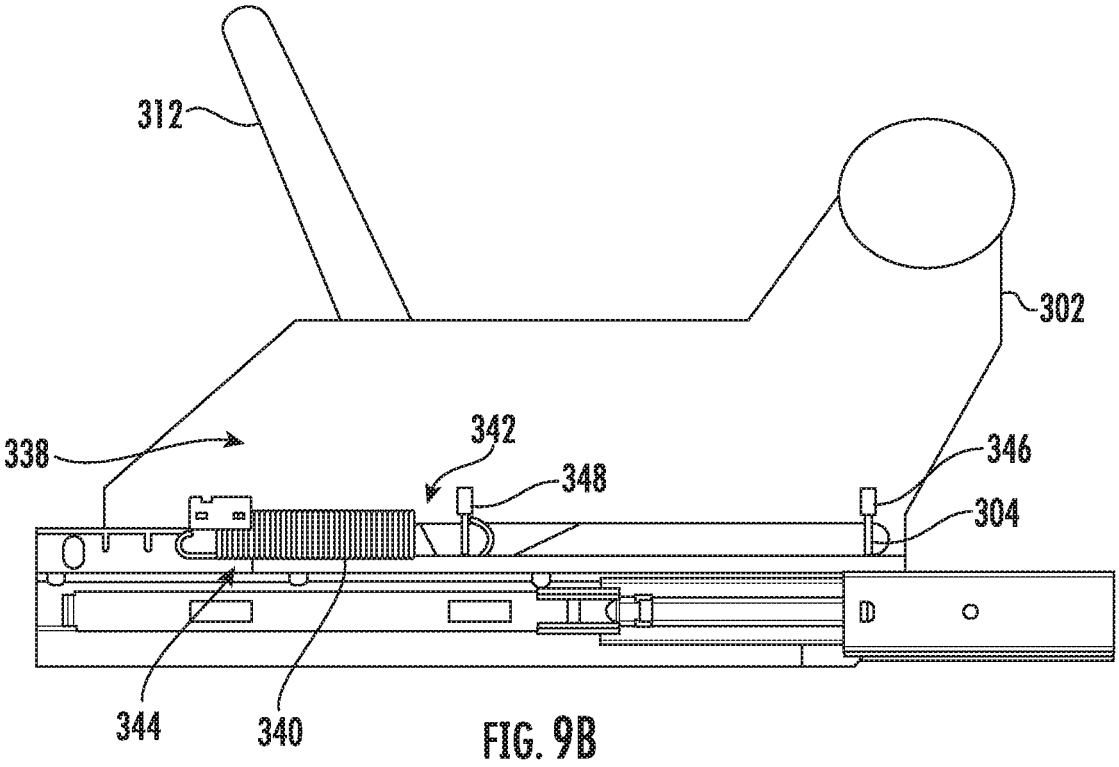
FIG. 9B is a side view of a basket lifting assembly (without the basket) aided by a coiled spring according to exemplary embodiments of the present disclosure, wherein the basket is in the raised position.

Referring now to FIGS. 9A and 9B, basket lifting assembly 300 may further comprise a coiled spring 340. Coiled spring 340 may be oriented parallel to horizontal rail 304 of support frame assembly 302. Coiled spring 340 may further have a first end 342 and second end 344. First end 342 of coiled spring 340 may be connected to guide post 330. Second end 344 of coiled spring 340 may be connected (e.g., fixedly connected) to a front end 338 of basket lifting assembly 300 extending away from insulated chamber 99. When basket 306 is in the lowered position, guide post 330 may be at its furthest position from front end 338 of basket lifting assembly 300 (e.g., along the transverse direction T). Thus, coiled spring 340 may be in an extended position, exerting a force on guide post 330 in the direct of front end 338 of basket lifting assembly 300. This force may assist motor 310 in lifting basket 306 and its contents, reducing the torque required of motor 310. Additionally or alternatively, when basket 306 is in the lifted position, guide post 330 may be at its nearest to front end 338 of basket lifting assembly 300. Thus, coiled spring 340 may be in a retracted position. Advantageously, coiled spring 340 may aid in maintaining the lifted position of basket 306 by requiring basket 306 to overcome the tension force of coiled spring 340 in order to move to the lowered position.

In certain embodiments, basket lifting assembly 300 further includes a first lift state sensor 346 and a second lift state sensor 348. As shown in FIGS. 9A and 9B, first lift state sensor 346 is mounted on support frame assembly 302 and is positioned in alignment with guide post 330 at a lowered position of basket 306. Second lift state sensor 348 is mounted on support frame assembly 302 and is positioned in alignment with guide post 330 at a raised position of basket 306. When basket 306 is in the lowered position, therefore, guide post 330 triggers first lift state sensor 346, which may alert controller 144 to cease actuation of motor 310. Likewise, when basket 306 is in the raised position, guide post 330 triggers second lift state sensor 348, which may alert controller 144 to cease actuation of motor 310.

In other embodiments, first lift state sensor 346 may be positioned in alignment with first linkage 308 at a lowered position of basket 306 and second lift state sensor 348 may be position in alignment with first linkage 308 at a raised position of basket 306. Similar to the previously discussed embodiment, first lift state sensor 346 and second lift state sensor 348 may alert controller 344 to cease actuation of motor 306 upon being triggered by first linkage 308.

First lift state sensor 346 and second lift state sensor 348 may be limit switches in some embodiments. In yet other embodiments, one or both of first lift state sensor 346 and second lift state sensor 348 are Hall-effect sensors, which sense the magnetic field of magnets mounted on or in, for example, guide post 330 or first linkage 308 in the embodiments discussed above. Certain embodiments include additional lift state sensors (e.g., between the first lift state sensor 346 and second lift state sensor 348), such as to monitor a proxy of the position of basket 306 while being lifted or lowered to ensure that the process is proceeding as expected.

In some embodiments, such as shown in FIG. 10, basket lifting assembly 300 includes a slotted shaft 350 extending vertically on a back side 352 of basket 306. Additionally or alternatively, basket lifting assembly 300 further may include a basket lift guide 354 mounted to support frame assembly 302. In some such embodiments, basket lift guide 354 includes a protrusion 356 on a front side 358 of basket lift guide 354. Generally, protrusion 356 aligns with slotted shaft 350. In specific embodiments, protrusion 356 is slidably contained with slotted shaft 350. Thus, as basket 306 is moved between a lowered position to a raised position, protrusion 356 slides within slotted shaft 350. Advantageously, the interaction of protrusion 356 and slotted shaft 350 prevents tilting of basket 306 as it transitions between raised and lowered states (e.g., between the lifted and lowered positions). Additionally or alternatively, slotted shaft 350 may be positioned and extend vertically on an inside surface of door 154. In some such embodiments, protrusion 356 is located on a front side of basket 306 in alignment with slotted shaft 350 so as to be slidably contained within slotted shaft 350 as previously described. Optionally, such embodiments may not require basket lift guide 354.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance comprising:
- a cabinet;
- an insulated chamber mounted within the cabinet;
- a basket lifting assembly comprising
  - a support frame assembly at least partially contained within the insulated chamber, the support frame assembly including a horizontal rail;
  - a basket movably attached to the support frame assembly;
  - a first linkage movably attached to the support frame assembly in mechanical communication with the basket;
  - a motor connected to the first linkage, wherein actuation of the motor causes rotation of the first linkage;
  - a second linkage comprising
    - a first arm having a first end and a second end, the first end of the first arm connected to the first linkage;
    - a second arm having a first end and a second end, the first end of the second arm connected to the basket and the second end of the second arm connected to the second end of the first arm at an arm joint defining an arm angle of less than 180 degrees; and
    - a guide post positioned between the second linkage and the horizontal rail, the guide post connected to the second linkage at the arm joint.

2. The refrigerator appliance of claim 1, wherein the support frame assembly further comprises
- a first support bracket fixedly mounted within the insulated chamber;
- a second support bracket slidably connected to the first support bracket, the second support bracket being movable between a retracted position within the insulated chamber of the refrigerator appliance and an extended position at least partially outside of the insulated chamber of the refrigerator appliance; and
- a mounting frame connected to the second support bracket.

3. The refrigerator appliance of claim 2, wherein the second support bracket is further connected to a door of the refrigerator appliance.

4. The refrigerator appliance of claim 3, wherein
- the door further includes a slotted shaft extending vertically on an inside surface of the door; and
- the basket of the basket lifting assembly further includes a protrusion on a front side of the basket, the protrusion being slidably contained within the slotted shaft of the door.

5. The refrigerator appliance of claim 1, wherein the basket lifting assembly has a front end extending away from the insulated chamber and further comprises a coiled spring oriented parallel to the horizontal rail of the support frame assembly, the coiled spring having a first end connected to the guide post and a second end fixedly connected to the front end of the basket lifting assembly.

6. The refrigerator appliance of claim 1, wherein a first lift state sensor and a second lift state sensor are mounted on the support frame assembly, the first lift state sensor positioned in alignment with the first linkage at a lowered position of the basket, and the second lift state sensor positioned in alignment with the first linkage at a lifted position of the basket.

7. The refrigerator appliance of claim 6, wherein the first lift state sensor and the second lift state sensors are limit switches.

8. The refrigerator appliance of claim 6, wherein the first lift state sensor and the second lift state sensors are Hall effect sensors.

9. The refrigerator appliance of claim 1, wherein a first lift state sensor and a second lift state sensor are mounted on the support frame assembly in proximity to the rail, the first lift state sensor positioned in alignment with the guide post at a lowered position of the basket and the second lift state sensor positioned in alignment with the guide post at a lifted position of the basket.

10. The refrigerator appliance of claim 9, wherein the first lift state sensor and the second lift state sensors are limit switches.

11. The refrigerator appliance of claim 9, wherein the first lift state sensor and the second lift state sensor are Hall effect sensors.

12. The refrigerator appliance of claim 1, wherein the basket lifting assembly further comprises a slotted shaft extending vertically on a back side of the basket; and a basket lift guide mounted to the support frame assembly, the basket lift guide having a protrusion on a front side of the basket lift guide, the protrusion being slidably contained within the slotted shaft of the basket.

13. A basket lifting assembly comprising:

a support frame assembly including a horizontal rail;

a basket movably attached to the support frame assembly;

a first linkage movably attached to the support frame assembly in mechanical communication with the basket;

a motor connected to the first linkage, wherein actuation of the motor causes rotation of the first linkage;

a second linkage comprising a first arm having a first end and a second end, the first end of the first arm connected to the first linkage;

a second arm having a first end and a second end, the first end of the second arm connected to the basket and the second end of the second arm connected to the second end of the first arm at an arm joint defining an arm angle of less than 180 degrees; and a guide post positioned between the second linkage and the horizontal rail, the guide post connected to the second linkage at the arm joint.

14. The basket lifting assembly of claim 13, wherein the basket lifting assembly further includes a door, the door being connected to the support frame assembly.

15. The basket lifting assembly of claim 14, wherein the door further includes a slotted shaft extending vertically on an inside surface of the door; and the basket of the basket lifting assembly further includes a protrusion on a front side of the basket, the protrusion being slidably contained within the slotted shaft of the door.

16. The basket lifting assembly of claim 13, wherein the basket lifting assembly has a front end and further comprises a coiled spring oriented parallel to the horizontal rail of the support frame assembly, the coiled spring having a first end connected to the guide post and a second end fixedly connected to the front end of the basket lifting assembly.

17. The basket lifting assembly of claim 13, wherein a first lift state sensor and a second lift state sensor are mounted on the support frame assembly, the first lift state sensor positioned in alignment with the first linkage at a lowered position of the basket, and the second lift state sensor positioned in alignment with the first linkage at a lifted position of the basket.

18. The basket lifting assembly of claim 13, wherein a first lift state sensor and a second lift state sensor are mounted on the support frame assembly in proximity to the rail, the first lift state sensor positioned in alignment with the guide post at a lowered position of the basket and the second lift state sensor positioned in alignment with the guide post at a lifted position of the basket.

19. The basket lifting assembly of claim 13, further comprising:

a slotted shaft extending vertically on a back side of the basket; and a basket lift guide mounted to the support frame assembly, the basket lift guide having a protrusion on a front side of the basket lift guide, the protrusion being slidably contained within the slotted shaft of the basket.

20. A basket lifting assembly comprising:

a support frame assembly including a horizontal rail;

a door connected to the support frame assembly;

a basket movably attached to the support frame assembly;

a first linkage movably attached to the support frame assembly in mechanical communication with the basket;

a motor connected to the first linkage, wherein actuation of the motor causes rotation of the first linkage;

a second linkage comprising a first arm having a first end and a second end, the first end of the first arm connected to the first linkage;

a second arm having a first end and a second end, the first end of the second arm connected to the basket and the second end of the second arm connected to the second end of the first arm at an arm joint defining an arm angle of less than 180 degrees; and a guide post positioned between the second linkage and the horizontal rail, the guide post connected to the second linkage at the arm joint, wherein the basket lifting assembly has a front end and further comprises a coiled spring oriented parallel to the horizontal rail of the support frame assembly, the coiled spring having a first end connected to the guide post and a second end fixedly connected to the front end of the basket lifting assembly, and wherein a first lift state sensor and a second lift state sensor are mounted on the support frame assembly in proximity to the rail, the first lift state sensor positioned in alignment with the guide post at a lowered position of the basket and the second lift state sensor positioned in alignment with the guide post at a lifted position of the basket.

* * * * *